US010631586B2

(12) United States Patent
Brattli

(10) Patent No.: US 10,631,586 B2
(45) Date of Patent: Apr. 28, 2020

(54) TORSO-SHAPED PILLOW

(71) Applicant: Rhinestone Buddy LLC, Lighthouse Point, FL (US)

(72) Inventor: Loreen J. S. Brattli, Lighthouse Point, FL (US)

(73) Assignee: Rhinestone Buddy, LLC, Lighthouse Point, FL (US)

( * ) Notice: Subject to any disclaimer, the term of this patent is extended or adjusted under 35 U.S.C. 154(b) by 77 days.

(21) Appl. No.: 15/831,324

(22) Filed: Dec. 4, 2017

(65) Prior Publication Data

US 2018/0153240 A1 Jun. 7, 2018

Related U.S. Application Data

(60) Provisional application No. 62/429,741, filed on Dec. 3, 2016.

(51) Int. Cl.

| | |
|---|---|
| ***A41H 5/02*** | (2006.01) |
| ***A47G 9/10*** | (2006.01) |
| ***A63H 3/02*** | (2006.01) |
| ***A47G 9/02*** | (2006.01) |

(52) U.S. Cl.

CPC ..... *A41H 5/02* (2013.01); *A47G 9/0253* (2013.01); *A47G 9/10* (2013.01); *A47G 9/1045* (2013.01); *A63H 3/02* (2013.01)

(58) Field of Classification Search

CPC ... A41H 5/02; A41H 5/00; A41H 5/01; A47G 9/0253; A47G 9/10; A47G 9/1045; A47G 9/1009–1081; A47G 9/109

USPC ..... D6/599

See application file for complete search history.

(56) References Cited

U.S. PATENT DOCUMENTS

| | | | | | |
|---|---|---|---|---|---|
| 3,475,852 | A * | 11/1969 | Brosk | A47G 25/28 | 446/369 |
| D258,406 | S * | 3/1981 | Elbaum | A63H 3/06 | 5/490 |
| 5,027,457 | A * | 7/1991 | Sweet | A47G 9/0253 | 428/100 |
| D318,889 | S * | 8/1991 | Van Staagen | 5/632 | |
| D368,823 | S * | 4/1996 | Cancellieri | A47C 20/021 | D20/31 |
| 5,515,563 | A * | 5/1996 | Chao | A47C 20/021 | 446/369 |
| 6,170,721 | B1 * | 1/2001 | Chen | A47G 25/0671 | 223/85 |
| D484,348 | S * | 12/2003 | Pappas | D6/597 | |

(Continued)

*Primary Examiner* — Ismael Izaguirre

(74) *Attorney, Agent, or Firm* — Witkowski Law

(57) ABSTRACT

A pillow case and pillow in the shape of a human torso, for altering clothes worn on the pillow; the human torso including a human trunk and a first pair of base portions of appendages extending out from the trunk substantially at the position and with the orientation of human arms relative to the human trunk, each substantially in the shape of the base portion of human arms; a second pair of base portions of appendages extending out from the trunk substantially at the position and with the orientation of human legs relative to the human trunk, each substantially in the shape of the base portion of human legs; and a base portion of an appendage extending out from the trunk, substantially at the position and with the orientation of a neck relative to the human trunk, substantially in the shape of the base portion of a human neck.

9 Claims, 18 Drawing Sheets

(56) References Cited

U.S. PATENT DOCUMENTS

| | | | | | |
|---|---|---|---|---|---|
| D485,403 | S | * | 1/2004 | Inder | D32/66 |
| 6,688,940 | B2 | * | 2/2004 | Stanier | A63H 3/06 446/224 |
| D496,078 | S | * | 9/2004 | DesRosier | A47G 9/0253 D21/635 |
| D509,856 | S | * | 9/2005 | Veitch | D20/31 |
| D603,644 | S | * | 11/2009 | Ketner | A47G 25/28 D6/597 |

* cited by examiner

TORSO-SHAPED PILLOW

BACKGROUND

Field

This disclosure relates generally to the field of applying ornaments and appliqués to clothing; more specifically, the disclosure relates to a filled or inflated torso-shaped pillow for attaching ornaments and appliques to clothing.

Related Art

The market value of the clothing industry in the United States was estimated to be about $225 billion dollars in 2012. The market value of the clothing-alteration market was estimated to be about $1 billion dollars in the United States.

Many people create and alter clothing for personal, non-commercial purposes. They make such alterations to repair, tailor and personalize clothing for themselves, their family and friends. For example, a parent may attach rhinestones and appliqués to dance outfits for their child's dance performances, or make modifications to garments to create a Halloween costume for their kids.

Dressmaker forms are used by clothing designers and manufacturers, costume designers, and other professionals to design, tailor and alter articles of clothing.

Dressmaker forms are structures that typically have a component that is shaped like a life-sized portion of a human figure, such as a torso. The torso is supported by a stand that rests on a floor such that the torso has an orientation and height of a standing person. The size and height of the torso may vary as heights and sizes of individuals vary. Articles of clothing such as a floor-length dress can then be fitted to the torso by hanging on the torso as if it were worn by a person. Modifications may be made to the clothing while it is in place on the dressmaker form.

Dressmaker forms are substantial in size and weight, and are cumbersome.

Manikins are life-sized human figures, sometimes limited to torsos or other portions of a human body. Manikins often have working joints so that the head, arms and legs can be posed as desired.

Manikins are used by clothing designers and manufacturers, costume designers, and other professionals to design, tailor and alter articles of clothing. They are also used to display clothing in retail stores.

Flat-back torso forms are sometimes used to display garments, but have limited use for designing, altering or tailoring clothing since they have a flat back that does not replicate the shape of the body parts as well as a more fully-formed manikin.

The figures of dressmaker forms and manikins are typically made of fiberglass, polystyrene, or wood. They can be bulky and cumbersome.

A person who performs design, tailoring and alterations for personal use may not do so on a frequent enough basis to justify the cost or the space required to maintain a dressmaker form or manikin in their home. What is needed are devices for design, tailoring and alterations that are more suitable for occasional or home use.

A person may want to perform design, tailoring and alterations in changing locations. What is needed are devices for design, tailoring and alterations that are more suitable for storage, transportation and remote use.

SUMMARY

Embodiments of the disclosure include a pillow case, formed such that when stuffed with stuffing material, it expands to be a torso-shaped pillow that includes base portions of arms, base portions of legs and a base portion of a neck. The torso-shaped pillow case may be sold or transported unfilled. In the unfilled state, the torso-shaped pillow case can be more densely packed and stored, weigh less, and take up less space in distribution and retail stores.

Embodiments of the torso-shaped pillow case is made of a cloth material that can be stuffed with any number of stuffing materials including those traditionally used for pillows and beanbags. For example, the cloth material may be cotton, linen, polyester, wool, nylon, or rayon, or blends of such materials. The stuffing material may be, for example, craft stuffing, synthetic foams such as polyester fiber fills, latex, and polystyrene beans, and natural fiber fills such as down, feathers, wool, and cotton. When the torso-shaped pillow case is stuffed, it becomes a torso-shaped pillow.

Embodiments of the torso-shaped pillow case include a zipper opening in the cloth torso cover to allow for the insertion and removal of stuffing materials.

Embodiments of the torso-shaped pillow are made of an air-tight material with a sealable air valve such that it can be inflated by mouth or by using an air pump. Such air-tight materials may be polyvinyl chloride (PVC), nylon polyester, textile-reinforced urethane plastic, and rubber.

Embodiments of the torso-shaped pillow have a cloth cover with an inflatable core made of an air-tight material such as polyvinyl chloride (PVC), nylon polyester, textile-reinforced urethane plastic, or rubber. The core has a sealable air valve so that it can be inflated for use as described herein and deflated for storage and transportation. In some embodiments, the torso-shaped cover has an exterior made of cloth and an interior piece made of air-tight material shaped to support the torso-shaped cloth material when inflated.

Embodiments of the torso-shaped pillow case includes a zipper opening in the cloth torso-shaped cover to allow for the insertion and removal of a core made of air-tight material having a cavity with a sealable air value so that it can be inflated for use as described herein and deflated for storage and transportation. The core made of air-tight material is shaped to support the torso-shape of the torso-shaped pillow case when inserted into the cloth covering, oriented to align with the corresponding features of the torso-shaped cloth pillow case, and inflated.

Embodiments of the torso-shaped pillow can be stuffed with stuffing material or inflated with air so that the torso-shaped pillow maintains the torso-shape when dressed with clothing made of stretch fabrics, such as bathing suits and costumes for dancers, ice skaters, cheerleaders, and gymnasts. Ornaments such as beading, sequences, rhinestones, crystals or appliqués can be secured to the surface of clothing worn by the filled or inflated torso-shaped pillow. The torso-shaped pillow, when stuffed or inflated, may also be clothed with dresses, shirts, tops, and other clothing articles that might be decorated such as party dresses, prom attire, or special-occasion shirts and tops.

Embodiments of the torso-shaped pillow, when stuffed or inflated, and dressed with clothing, provide a constant work surface in that the surface of clothing are spread apart in the same way it would be when worn by a person. Thus, alterations can be better positioned in the physical context of other features and modifications of the clothes. Appliqués and other ornaments can be provisionally positioned with pins to arrange them in the context of other features and ornaments for design and layout purposes. Furthermore, when ornaments are glued into position, they can be maintained in that position until the glue dries.

Embodiments of the filled or inflated torso-shaped pillow are more portable than dressmaker forms and manikins. Embodiments of the torso-shaped pillows are not mounted on a stand like dressmaker forms. Embodiments of the torso-shaped pillow are not as cumbersome in that they do not have fully formed arms or legs like many manikins. Embodiments of the torso-shaped pillow can be dressed with clothing and horizontally laid on a table to attach materials to the clothing and otherwise modify such clothing. Alternatively, the stuffed torso can be placed in a lap to work on while sitting on a couch watching television.

Embodiments of the torso-shaped pillow are more portable than dressmaker forms and manikins in that they use softer, more compressible materials than the fiberglass, polystyrene, and wood typically used for dressmaker forms and manikins. Embodiments of the torso-shaped pillow can be conveniently packed and transported. For example, one can throw a torso-shaped pillow in a bag or the trunk of a car. Embodiments of the torso-shaped pillow can be squeezed into luggage.

Embodiments of the torso-shaped pillow can also be disassembled in that the stuffing material can be removed and the torso-shaped pillow case can be packed and transported. The torso-shaped pillow case can be stuffed with stuffing material at the remote location. Embodiments of the inflatable torso-shaped pillow can be deflated for packing, transportation or storage, and subsequently inflated for use.

Embodiments of the torso-shaped pillow may be transported to other locations for use outside the home. For example, a parent may take the torso-shaped pillow to the venues for their children's extracurricular activities—dance studios, skating rinks, parks, and stadiums, for example. The parent might work on a piece of clothing while the child is engaging in an extracurricular activity at the venue.

Embodiments of the torso-shaped pillow include attachable arm-shaped pillows to accommodate long-sleeve clothing and attachable leg-shaped pillows to accommodate pants and leggings. Embodiments of the arm-shaped and the leg-shaped pillows are removably connected to the torso-shaped pillow using Velcro at the base portions of the arms and legs. Embodiments of the attachments may be disassembled in that the stuffing material can be removed for packing and transportation when less room is available. Embodiments of the attachments may be uninflated for packing and transportation. Embodiments of the attachments may not include the full length of the arm or leg, and may not include the hands or feet, as those portions may not be necessary for working on the expected articles of clothing.

Reference in this specification to "one embodiment," "an embodiment," and "embodiments" means that a feature, structure, characteristic, advantage or benefit described in connection with the embodiment or embodiments are included in at least one embodiment of the disclosure, but may not be exhibited by other embodiments. The appearances of the phrase "in one embodiment" or the like in various places in the specification are not necessarily all referring to the same embodiment or embodiments, nor are separate or alternative embodiments mutually exclusive of other embodiments. Similarly, various requirements are described which may be requirements for some embodiments but not for other embodiments. The specification and drawings are to be regarded in an illustrative sense rather than a restrictive sense. Various modifications may be made thereto without departing from the spirit and scope as set forth in the claims.

DETAILED DESCRIPTION

The following description and drawings are illustrative and are not to be construed as limiting. Numerous specific details are described to provide a thorough understanding of the disclosure. However, in certain instances, well known or conventional details are not described in order to avoid obscuring innovative subject matter disclosed herein.

Figure 1:
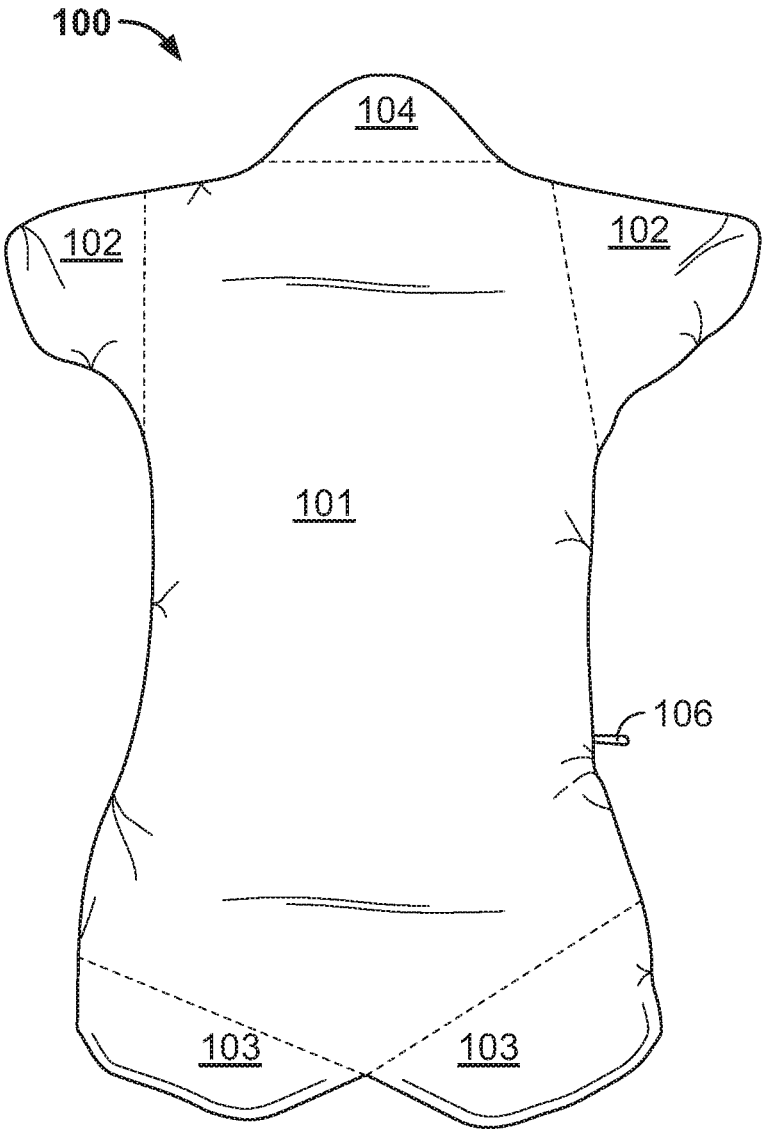
FIG. 1 is an illustration of one embodiment of the torso-shaped pillow case.

FIG. 1 is an illustration of one embodiment of the torso-shaped pillow case 100. The torso-shaped pillow case 100 including a trunk portion 101, a pair of appendages 102, a pair of appendages 103 and an appendage 104.

The trunk portion 101 is substantially in the shape of a human trunk when the pillow case is stuffed with filling material. Embodiments of the trunk portion 101 may be shaped to include at least a rough approximation of the features of a human trunk, such as a waist and chest of a male or female human.

When the torso-shaped pillow case 100 is stuffed with filling material, the pair of appendages 102 extend out from opposite sides of the trunk portion 101, substantially at the position, and with the orientation of human arms relative to the human trunk. Embodiments of the appendages 102 may be limited to just enough of a human arm to position the arm openings of a garment worn by the torso-shaped pillow. In some embodiments, the pair of appendages 102 may extend further out from the trunk portion 101 to support garments with short sleeves, or extend even further out from the trunk portion 101 to support garments with longer sleeves.

When the torso-shaped pillow case 100 is stuffed with filling material, the pair of appendages 103 extend out from the bottom of the trunk portion 101, substantially at the position, and with the orientation of human legs relative to the human trunk. Embodiments of the pair of appendages 103 may be limited to just enough of the human leg to position the leg openings of the garment worn by the torso-shaped pillow. In some embodiments, the pair of appendages 103 may extend further out from the trunk portion 101 to support garments with short leggings, or extend even further out from the trunk portion 101 to support garments with longer leggings.

When the torso-shaped pillow case 100 is stuffed with filling material, the appendage 104 extends out from the trunk portion 101, substantially at the position, and with the orientation of a human neck relative to the human trunk and the other appendages.

Figure 2:
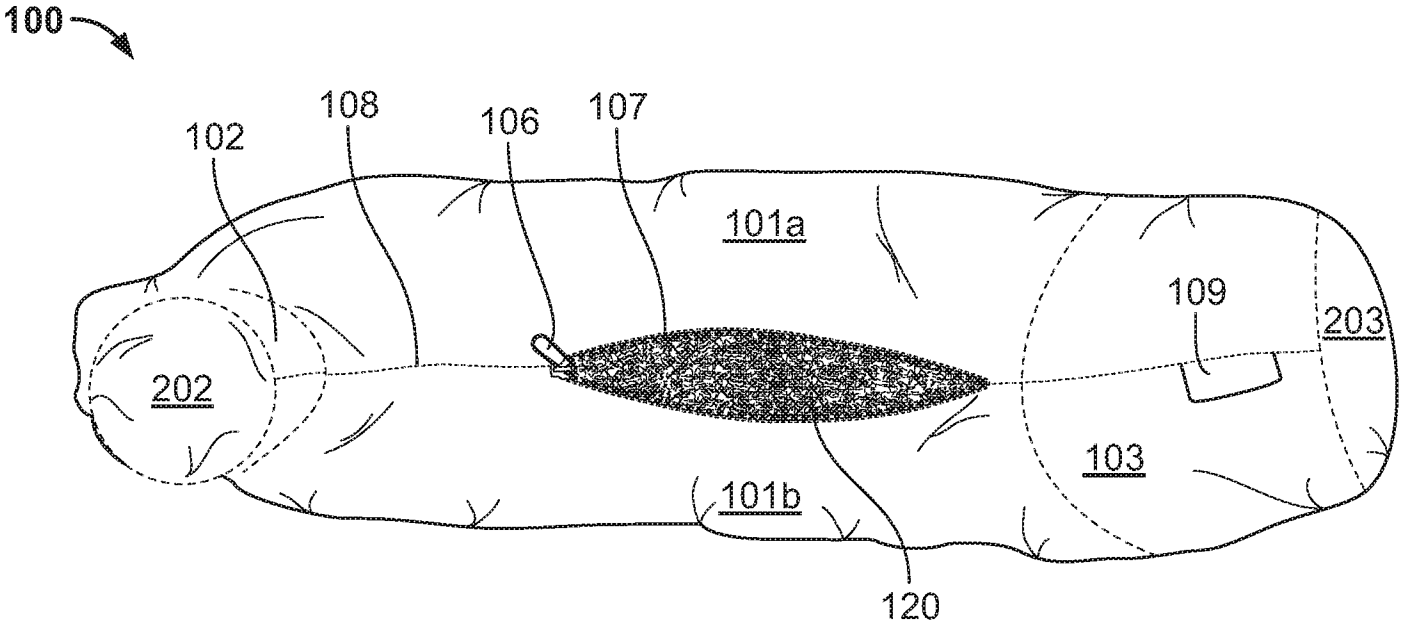
FIG. 2 is an illustration of a side view of one embodiment of the torso-shaped pillow.

FIG. 2 is an illustration of a side view of one embodiment of the torso-shaped pillow 100.

The torso-shaped pillow case 100 is formed by sewing a portion of the perimeter of a front pillow-case sheet 101*a* to a portion of the perimeter of a back pillow-case sheet 101*b* at a seam 108.

An opening in the torso-shaped pillow case 100 allows for a stuffing material 120 to be stuffed within the torso-shaped pillow case 100. A zipper-slider 106 is used to open and close the zipper teeth 107 along the edges of the opening in the torso-shaped pillow 100.

One of the pair of appendages 102 includes a circular filler pattern 202 sewn on to the end so that the appendage 102 takes on a substantially cylindrical shape. The other appendage 102 (not shown) also has a circular filler pattern 202 (not shown) sewn on to the end.

One of the pair of appendages 103 includes a circular filler pattern 203 sewn onto the end so that the appendage 103 takes on a substantially cylindrical shape. The other appendage 103 (not shown) also has a circular filler pattern 203 (not shown) sewn onto the end.

A brand tag 109 is attached to the seam 108. The brand tag 109 includes a trademark identifying the brand of the torso-shaped pillow 100.

Figure 3:
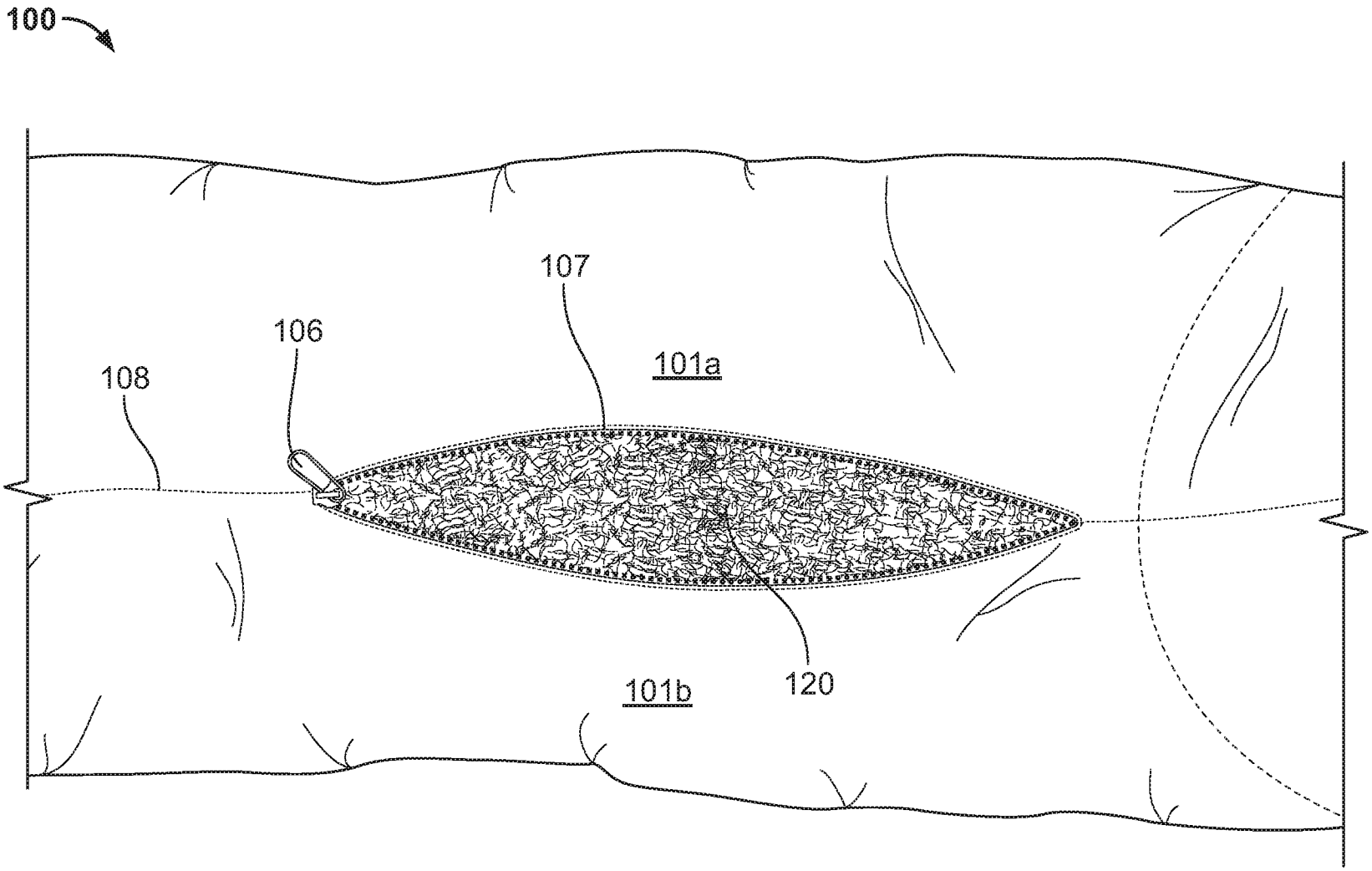
FIG. 3 is an illustration of one embodiment of a portion of a torso-shaped pillow with an open zipper.

FIG. 3 is an illustration of a close-up view of an open zipper of one embodiment of a torso-shaped pillow 100.

The torso-shaped pillow case 100 is formed by sewing a portion of the perimeter of the front pillow-case sheet 101*a* to a portion of the perimeter of the back pillow-case sheet 101*b* at the seam 108. The opening in the torso-shaped pillow case 100 allows for a stuffing material 120 to be stuffed within the torso-shaped pillow case 100. A zipper-slider 106 is used to open and close the zipper-teeth 107 along the edges of the opening of the torso-shaped pillow 100.

The stuffing material 120 is stuffed into the opening to fill out the torso-shaped pillow 100.

Figure 4:
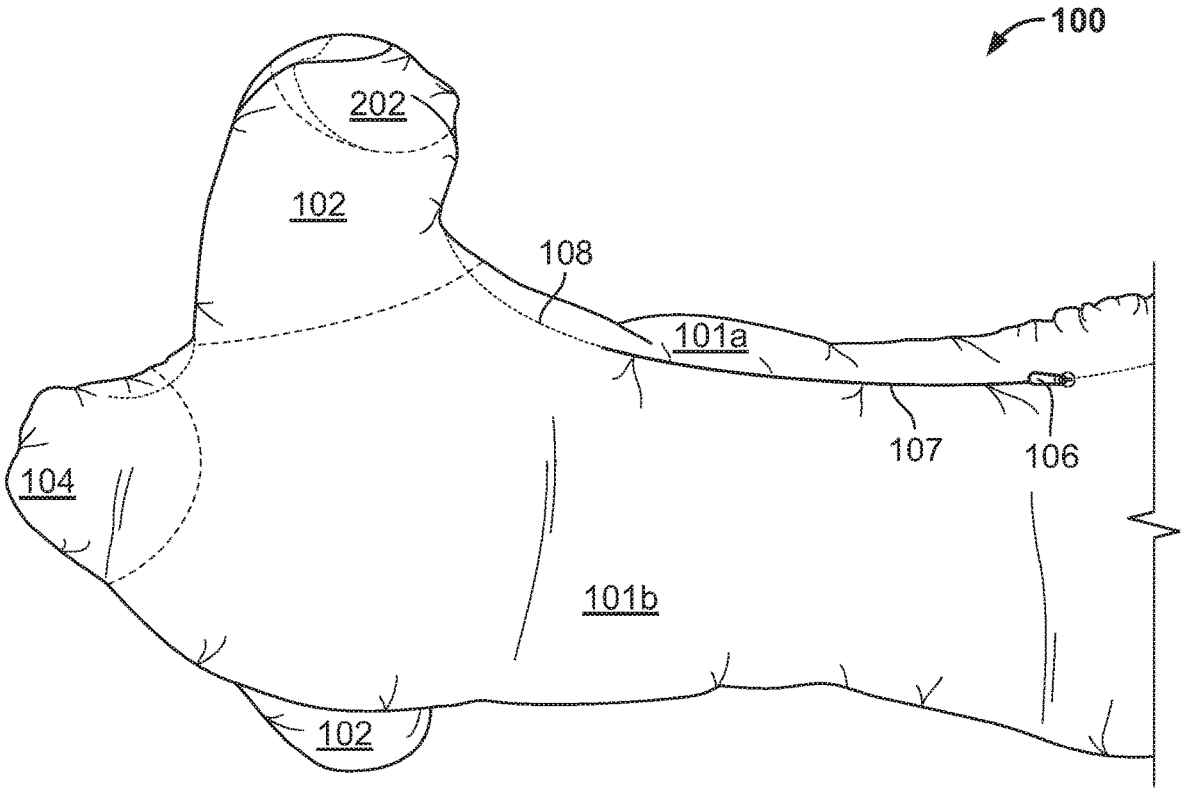
FIG. 4 is an illustration of a side perspective view of one embodiment of a torso-shaped pillow with a closed zipper.

FIG. 4 is an illustration of a side perspective view of one embodiment of a torso-shaped pillow with a closed zipper.

The torso-shaped pillow case 100 is formed by sewing a portion of the perimeter of a front pillow-case sheet 101*a* to a portion of the perimeter of a back pillow-case sheet 101*b* at the seam 108. The opening 107 in the torso-shaped pillow case 100 allows for a stuffing material 120 (not shown) to be stuffed within the torso-shaped pillow case 100 to fill out the torso-shaped pillow case 100. The zipper 106 is shown in a position that closes the opening. The zipper seals the stuffing material within the pillow 100.

The pair of appendages 102 extends out from opposite sides of the trunk portion 101, substantially at the position, and with the orientation of human arms relative to the human trunk.

One of the pair of appendages 102 includes a circular filler pattern 202 sewn on to the end so that the base portion of the appendage 102 takes on a substantially cylindrical shape. The other one of the pair of base portions of appendages 102 also has a circular filler pattern 202 (not shown) sewn on to the end of the other one of the pair of base portion of the appendages 102.

The base portion of appendage 104 extends out from the trunk portion 101, substantially at the position, and with the orientation of a human neck relative to human trunk and the other appendages.

Figure 5:
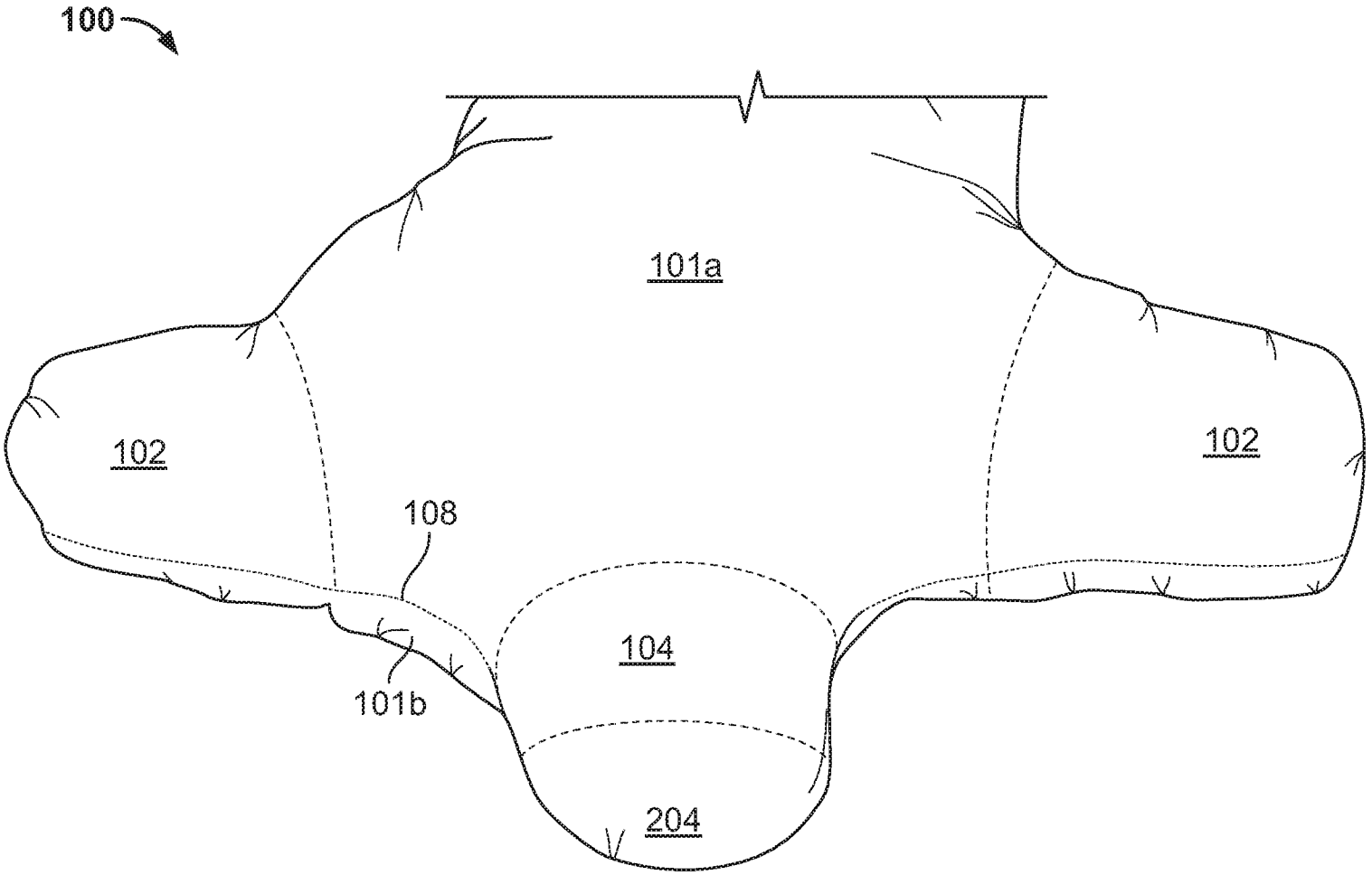
FIG. 5 is an illustration of a top perspective view of one embodiment of a torso-shaped pillow.

FIG. 5 is an illustration of a top perspective view of one embodiment of a torso-shaped pillow 100.

The pair of base portions of appendages 102 extends out from opposite sides of the trunk portion 101, substantially at the position, and with the orientation of human arms relative to the human trunk.

The torso-shaped pillow 100 is formed by sewing a portion of the perimeter of the front pillow-case sheet 101*a* to a portion of the perimeter of a back pillow-case sheet 101*b* at the seam 108, and filling the pillow case with stuffing material.

The pair of appendages 102 includes a circular filler pattern 202 (not shown) sewn on to the end so that the appendages 102 takes on a substantially cylindrical shape.

The appendage 104 extends out from the trunk portion 101, substantially at the position, and with the orientation of a human neck relative to human trunk and the other appendages.

The appendage 104 includes a circular filler pattern 204 sewn on to the end so that the base portion of the appendage 104 takes on a substantially cylindrical shape.

Figure 6:
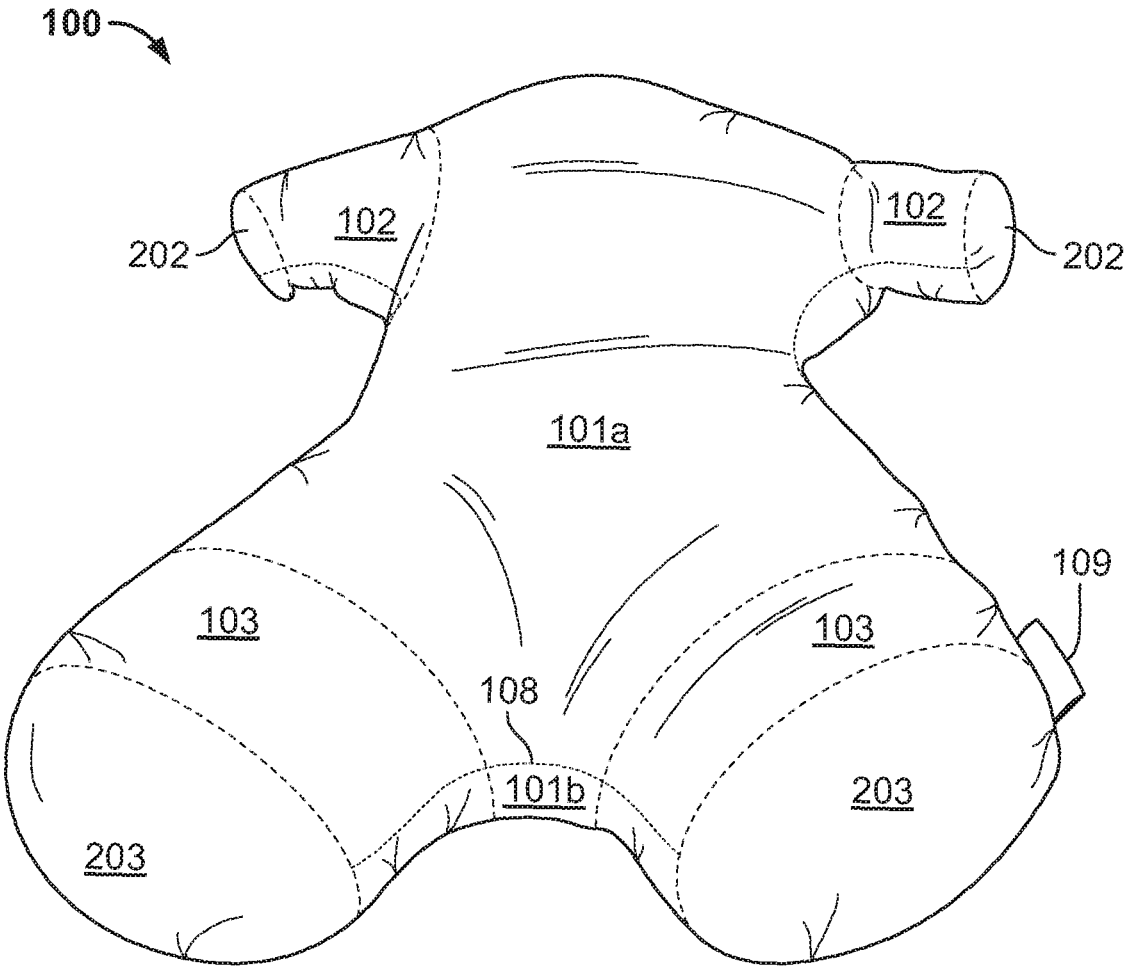
FIG. 6 is an illustration of a bottom perspective view of one embodiment of a torso-shaped pillow.

FIG. 6 is an illustration of a bottom perspective view of one embodiment of a torso-shaped pillow.

The torso-shaped pillow case 100 is formed by sewing a portion of the perimeter of a front pillow-case sheet 101*a* to a portion of the perimeter of a back pillow-case sheet 101*b* at the seam 108.

Each of the pair of appendages 102 includes a circular filler pattern 202 sewn on to the end so that each of the appendages 102 takes on a substantially cylindrical shape.

The appendages 103 extends out from the bottom of the trunk portion 101, substantially at the position, and with the orientation of a human legs relative to human trunk and the other appendages.

The appendages 103 includes a circular filler pattern 203 sewn on to the end so that the appendages 103 take on a substantially cylindrical shape.

A brand tag 109 includes a trademark identifying the brand.

Figure 7:
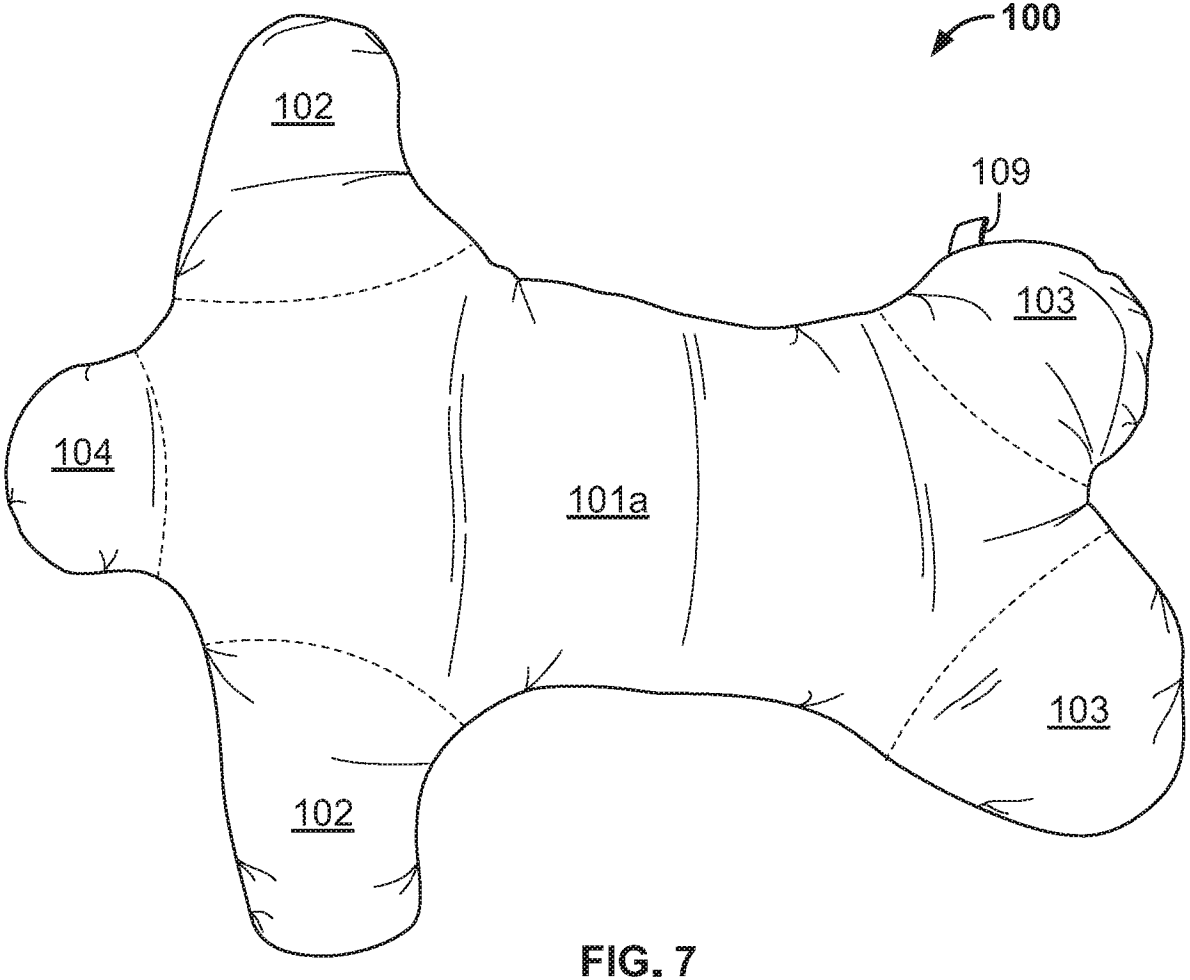
FIG. 7 is an illustration of a frontal view of one embodiment of a torso-shaped pillow.

FIG. 7 is an illustration of a frontal view of one embodiment of a torso-shaped pillow 100.

The torso-shaped pillow 100 is formed by sewing a portion of the perimeter of a front pillow-case sheet 101*a* to a portion of the perimeter of a back pillow-case sheet 101*b* (not shown).

Each of the pair of appendages 102 includes a circular filler pattern 202 (not shown) sewn on to the end so that each of the appendages 102 takes on a substantially cylindrical shape.

Each of the pair of base portions of appendages 103 includes a circular filler pattern 203 (not shown) sewn on to the end so that each base portion of the appendages 103 takes on a substantially cylindrical shape.

The pair base portion of appendages 104 includes a circular filler pattern 204 (not shown) sewn on to the end so that the base portion of the appendage 104 takes on a substantially cylindrical shape.

The brand tag 109 includes a trademark identifying the brand.

Figure 8:
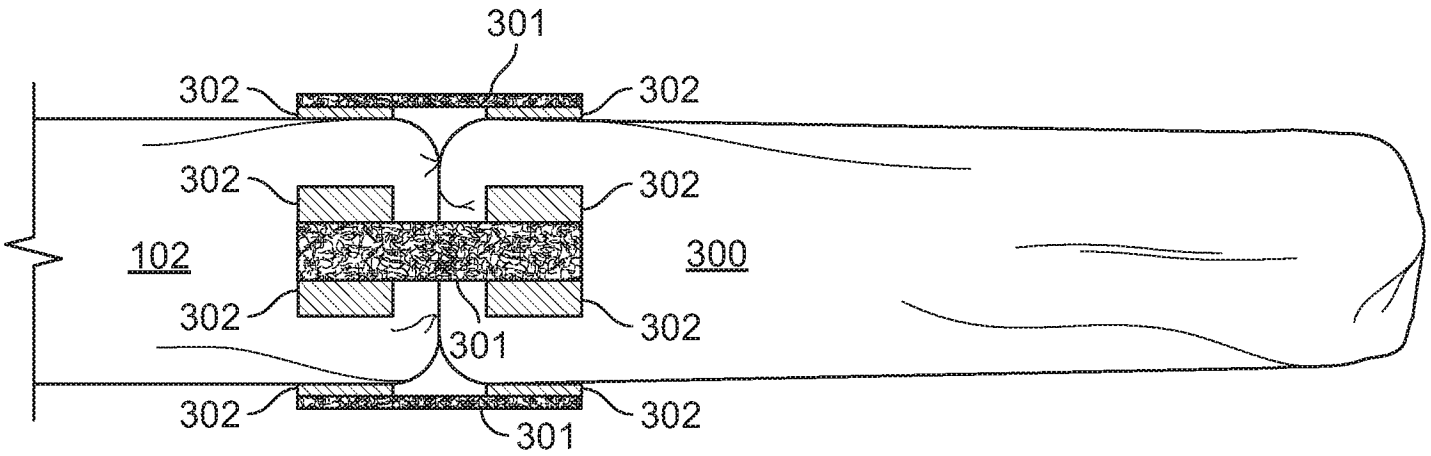
FIG. 8 is an illustration of one embodiment of an extension attached to an appendage.

FIG. 8 is an illustration of one embodiment of an extension attached to an appendage.

An appendage 102 is butted up against an extension 300. In some embodiments, the appendage 102 is an arm appendage as shown herein, and the extension is a pillow approximating the size and shape of a portion of an arm.

The extension 300 is secured in place against the appendage 102 by coupling corresponding Velcro pads 302 with a Velcro strap 301. For example, four Velcro straps may be positioned equidistant from each other along the circumference of the interface between the appendage and the extension. In some embodiments, the surfaces between the appendage and extension are secured together using Velcro.

In other embodiments, the appendage is a leg appendage and the extension is a pillow approximating the size and shape of a portion of a leg.

Figure 9:
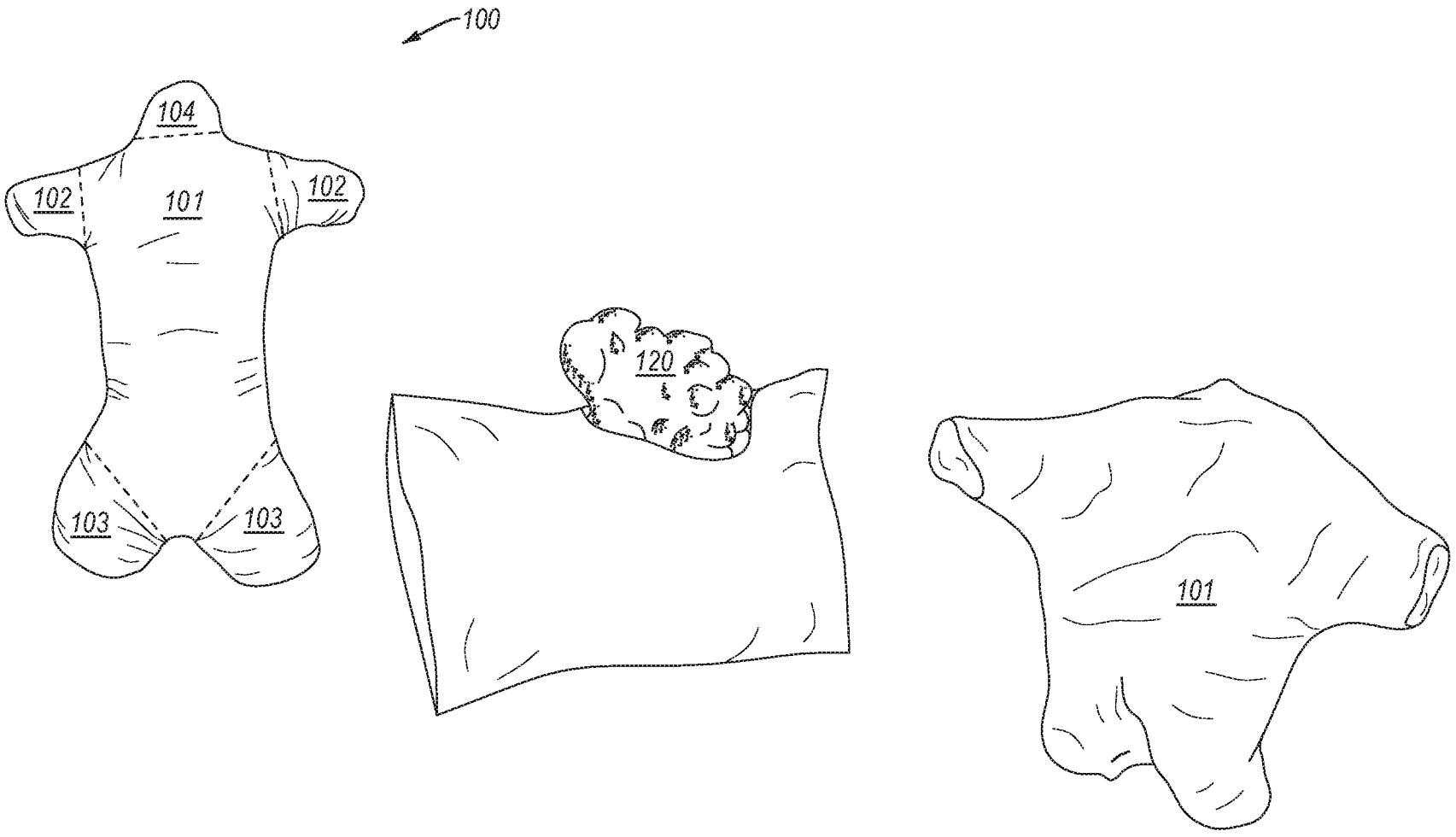
FIG. 9 is an image of a child stuffing one embodiment of a torso-shaped pillow with a stuffed pillow and a bag of filler material.

FIG. 9 is an image a child holding one embodiment of a torso-shaped pillow case 100 with a torso-shaped pillow 100 and a bag of stuffing material 120 in the background.

Figure 10:
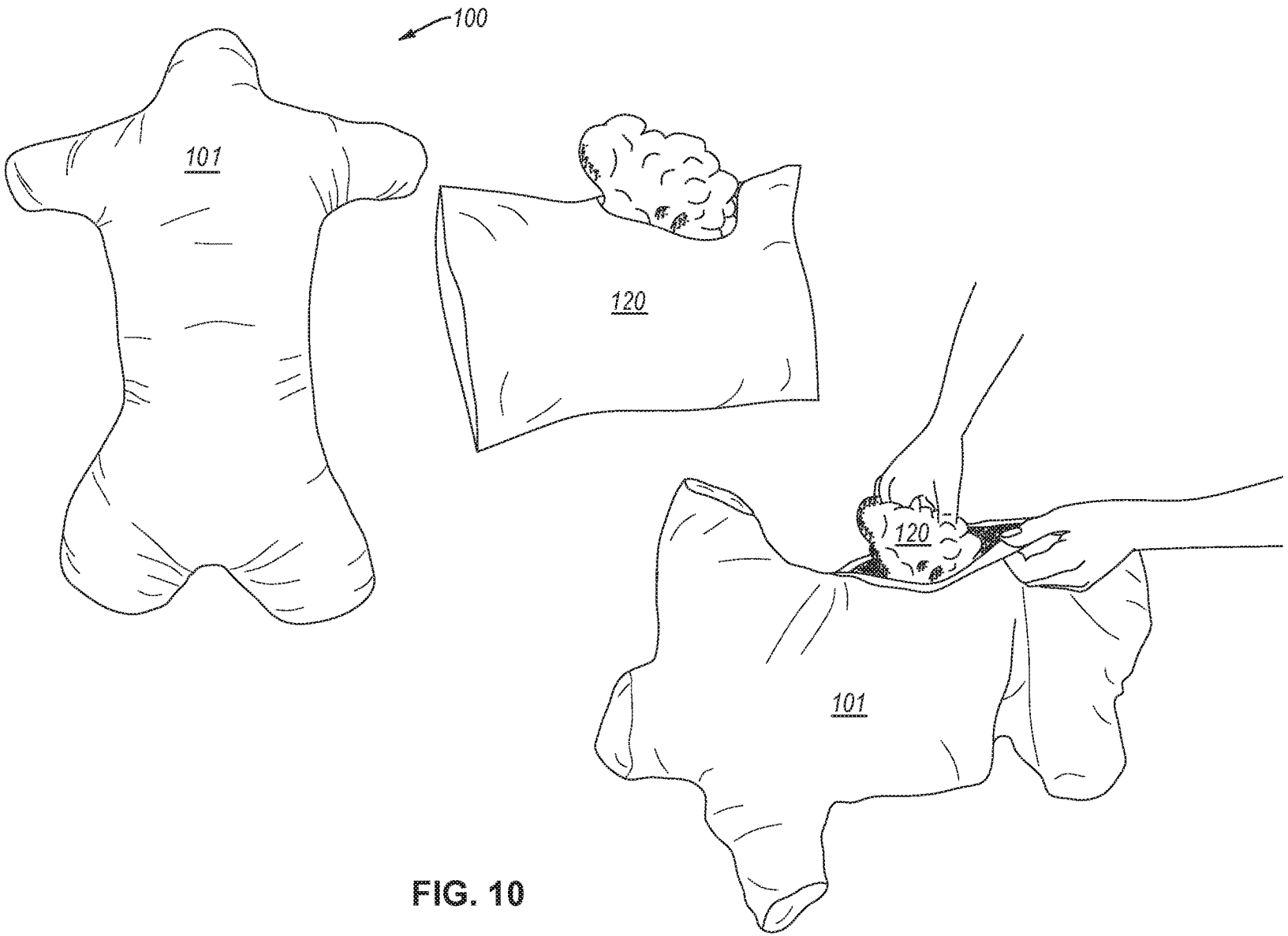
FIG. 10 is an image of a child stuffing one embodiment of a torso-shaped pillow.

FIG. 10 is an image of a child stuffing one embodiment of a torso-shaped pillow 100 with stuffing material 120 with a torso-shaped pillow 100 and a bag of stuffing material 120 in the background.

Figure 11:
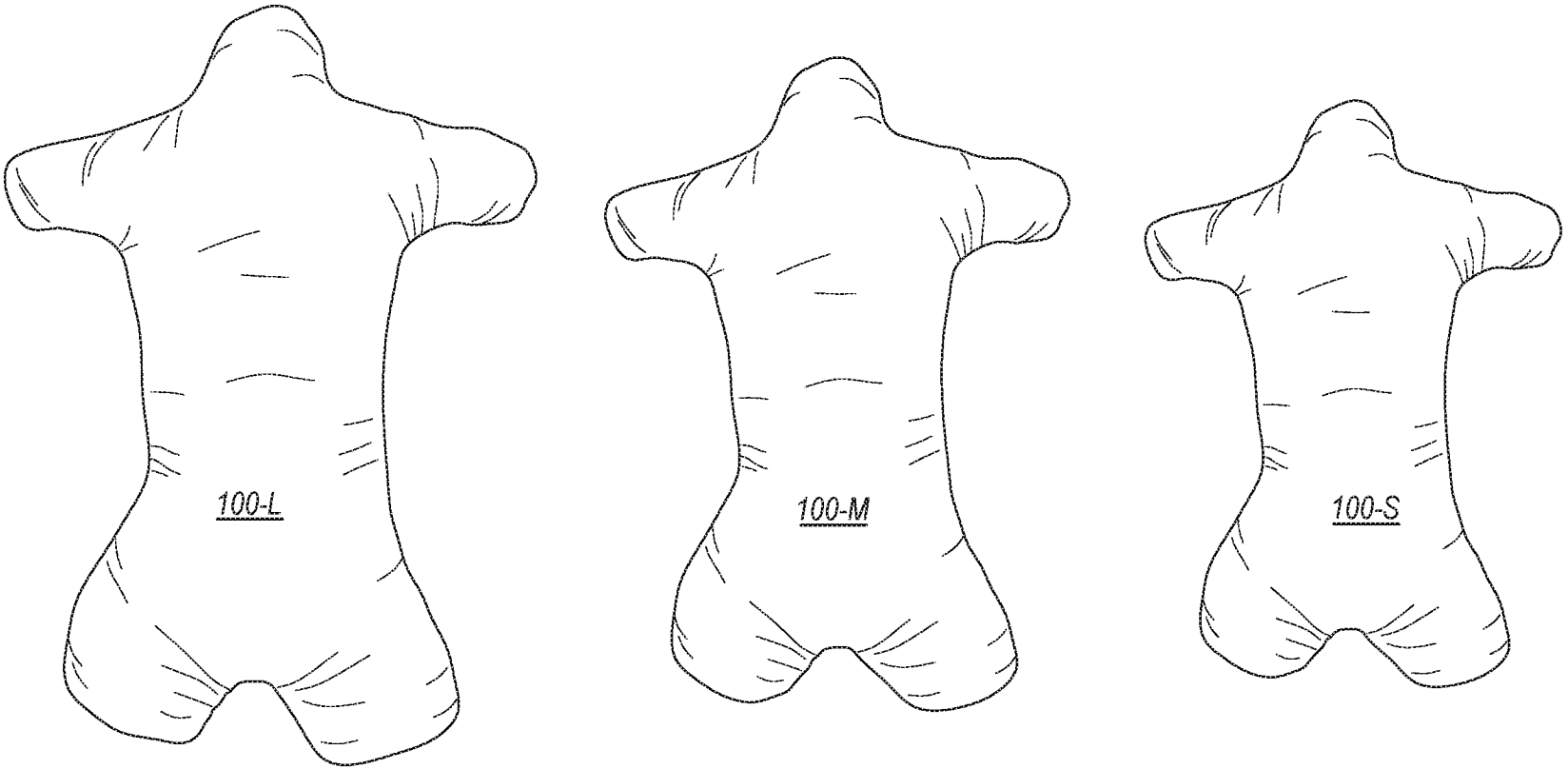
FIG. 11 is an image of small, medium and large embodiments of a torso-shaped pillow.

FIG. 11 is an image of embodiments of a small-sized torso-shaped pillow 100-S, medium-sized torso-shaped pillow 100-M and large-sized torso-shaped pillow 100-L.

Figure 12:
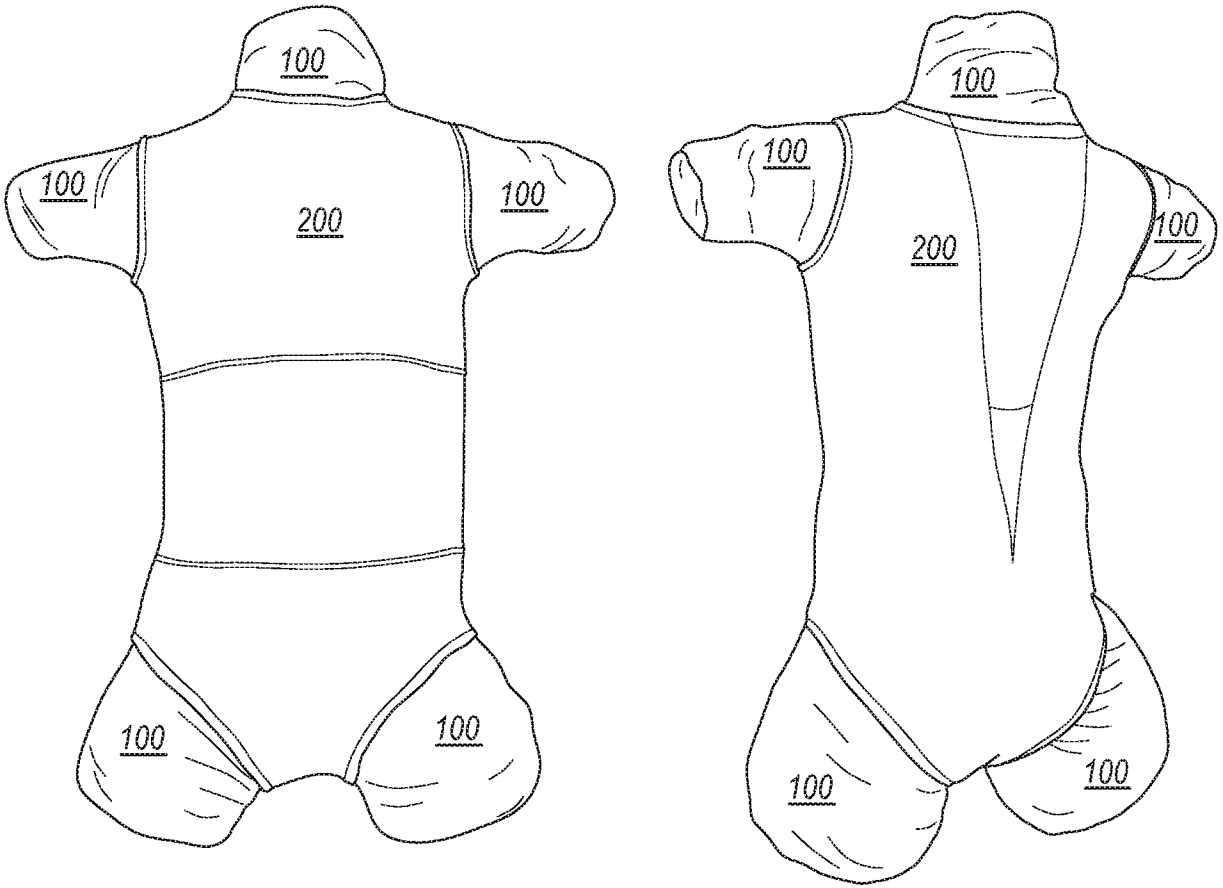
FIG. 12 is an image of two embodiments of a torso-shaped pillows, each dressed with stretch clothing.

FIG. 12 is an image of two embodiments of torso-shaped pillows 100, each dressed with stretch clothing 200.

Figure 13:
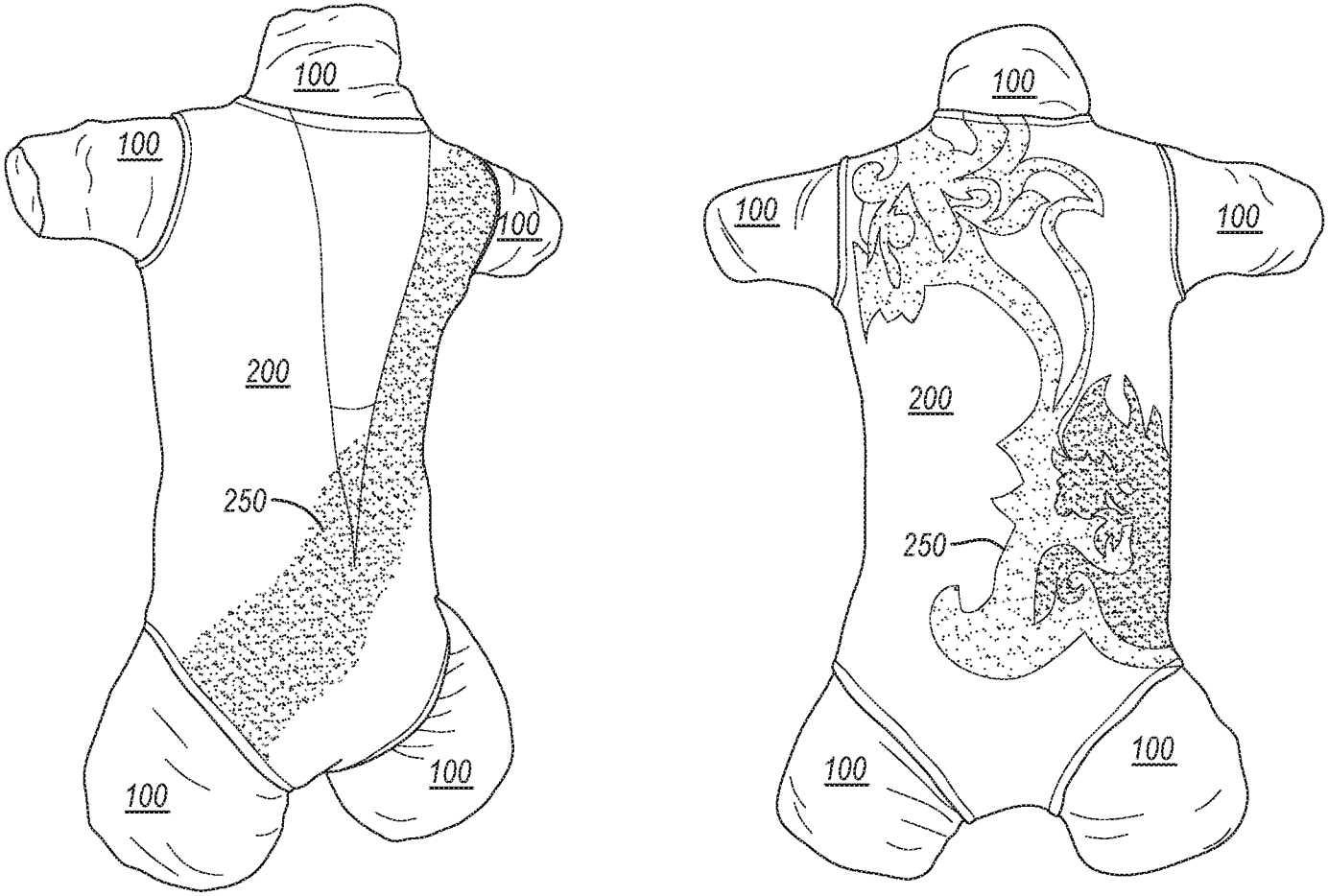
FIG. 13 is an image of two embodiments of a torso-shaped pillows, each dressed with stretch clothing that has been decorated with ornaments.

FIG. 13 is an image of two embodiments of torso-shaped pillows 100, each dressed with stretch clothing 200 that has been decorated with ornaments 250.

Figure 14:
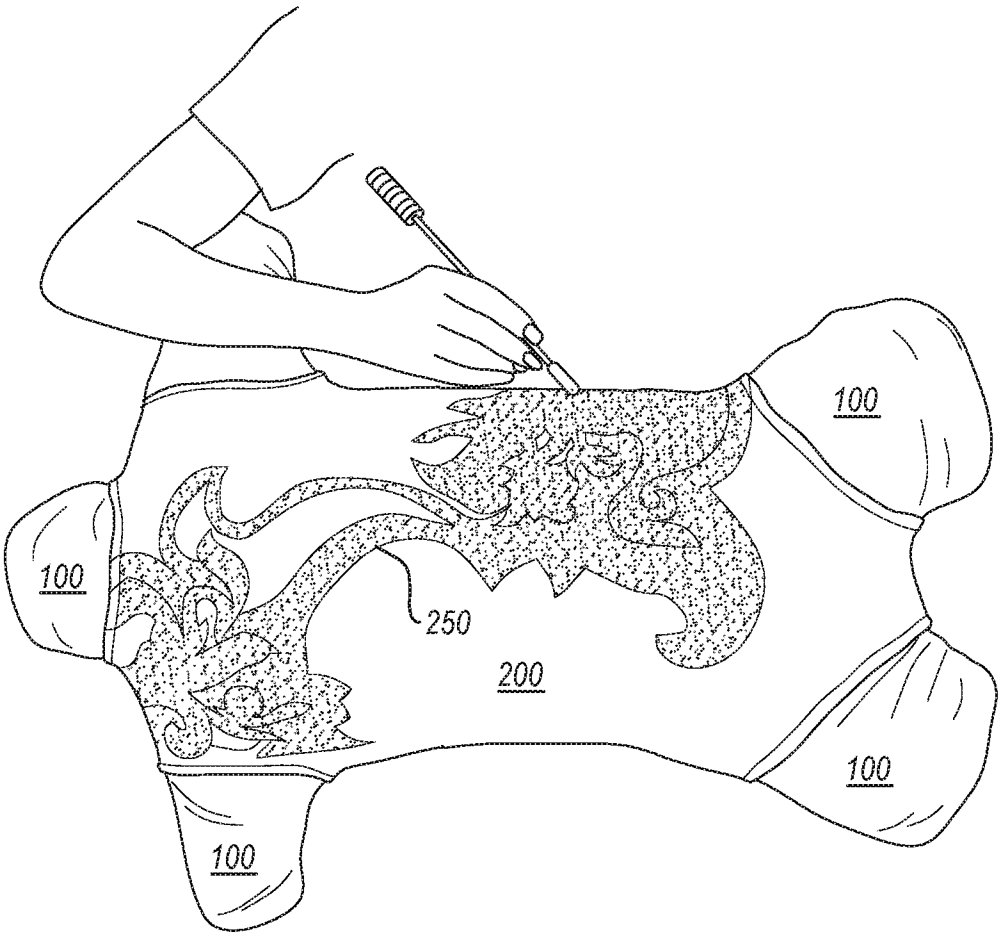
FIG. 14 is an image of a child decorating stretch clothing worn on an embodiment of a torso-shaped pillow.

FIG. 14 is an image of a child attaching ornaments 250 to stretch clothing 200 worn on an embodiment of a torso-shaped pillow 100.

Figure 15:
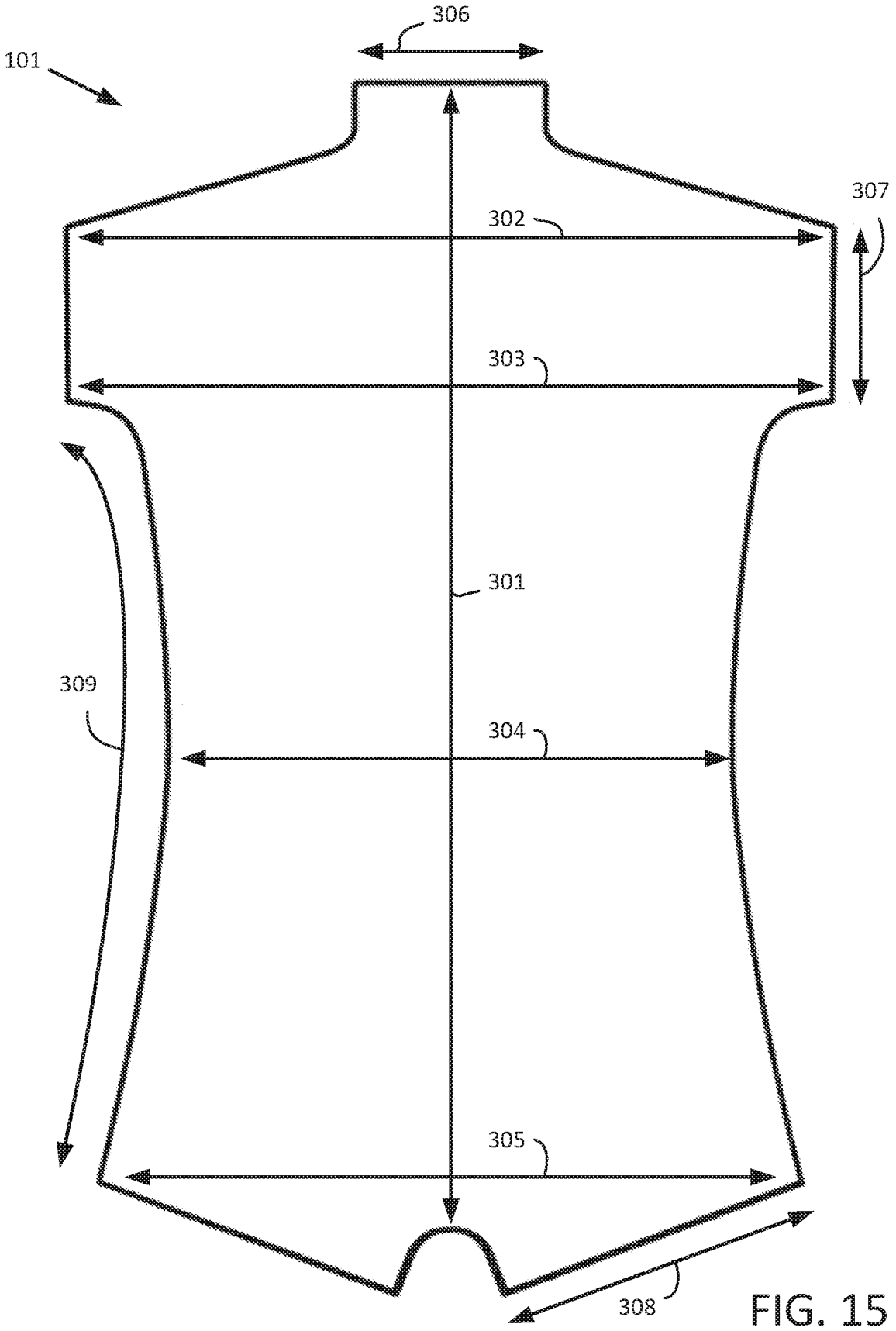
FIG. 15 is a diagram of key dimensions of one embodiment of a front or back sheet of the torso-shaped pillow case.

FIG. 15 is a diagram of key dimensions of one embodiment of a front or back sheet of the torso-shaped pillow case.

A center dimension 301 of the torso-shaped pillow case 100 runs from the center edge of the base portion of the neck to the center edge of the crotch. In a preferred embodiment, the center dimension 301 is 25 15/16 inches for a small pillow case 100, 28 3/8 inches for a medium pillow case 100, and 30 1/2 inches for a large pillow case 100.

A shoulder-sleeve dimension 302 of the torso-shaped pillow case 100 runs from the top edge of the base portion of the left arm to the top edge of the base portion of the right arm. In a preferred embodiment, the shoulder-sleeve dimension 302 is 19 3/8 inches for the small pillow case 100, 21 7/8 inches for the medium pillow case 100, and 23 1/2 inches for the large pillow case 100.

A chest-sleeve dimension 303 of the torso-shaped pillow case 100 runs from the bottom edge of the base portion of the left arm to the bottom edge of the base portion of the right arm. In a preferred embodiment, the chest-sleeve dimension 303 is 18 1/8 inches for the small pillow case 100, 20 3/8 inches for the medium pillow case 100, and 21 7/8 inches for the large pillow case 100.

A waist dimension 304 of the torso-shaped pillow case 100 runs across the width at the waist portion of the trunk. In a preferred embodiment, the waist dimension 304 is 11 3/8 inches for the small pillow case 100, 12 1/2 inches for the medium pillow case 100, and 14 1/4 inches for the large pillow case 100.

A hip dimension 305 of the torso-shaped pillow case 100 runs across the width at the hip portion of the trunk. In a preferred embodiment, the hip dimension 305 is 17 9/16 inches for the small pillow case 100, 19 7/8 inches for the medium pillow case 100, 21 7/8 inches for the large pillow case 100.

A neck-opening dimension 306 of the torso-shaped pillow case 100 is 5 1/2 inches for the small pillow case 100, 5 7/8 inches for the medium pillow case 100, and 6 3/8 inches for the large pillow case 100. When the perimeter seams of the front embodiment and back embodiment are sewn together the circular filler pattern representing the neck is sewn into the neck opening. A neck-circumference dimension of the torso-shaped pillow case 100 is the circumference of the base portion of the neck. In a preferred embodiment, the neck-opening dimension 306 is 11 inches for the small pillow case 100, 11 7/8 inches for the medium pillow case 100 and 12 5/8 inches for the large pillow case 100.

An arm-opening dimension 307 of the torso-shaped pillow case 100 is 4 1/16 inches for the small pillow case 100, 4 9/16 inches for the medium pillow case 100, and 4 3/4 inches for the large pillow case. When the perimeter seams of the front embodiment and back embodiment are sewn together the circular filler pattern representing arms are sewn into the arm openings. An arm-circumference dimension of the torso-shaped pillow case 100 is the circumference of the base portion of the legs. In a preferred embodiment, the arm-opening dimension 307 is 8 1/8 inches for the small pillow case 100, 9 1/8 inches for the medium pillow case 100, and 9 1/2 inches for the large pillow case 100.

A leg-opening dimension 308 of the torso-shaped pillow case 100 is 8 inches for the small pillow case 100, 9 1/8 inches for the medium pillow case 100, and 9 1/4 inches for the large pillow case. When the perimeter seams of the front embodiment and back embodiment are sewn together the circular filler pattern representing legs are sewn into the leg openings. A leg-circumference dimension of the torso-shaped pillow case 100 is the circumference of the base portion of the leg. In a preferred embodiment, the leg-opening dimension 308 is 16 inches for the small pillow case 100, 18 1/4 inches for the medium pillow case 100, and 20 1/2 inches for the large pillow case 100.

A total-seam-perimeter dimension 309 of the torso-shaped pillow case 100 is the length of the outside perimeter of each sheet. In a preferred embodiment, the total-seam-perimeter dimension 309 is 91 1/2 inches for the small pillow case 100, 102 inches for the medium pillow case 100 and 109 1/8 inches for the large pillow case 100.

Figure 16:
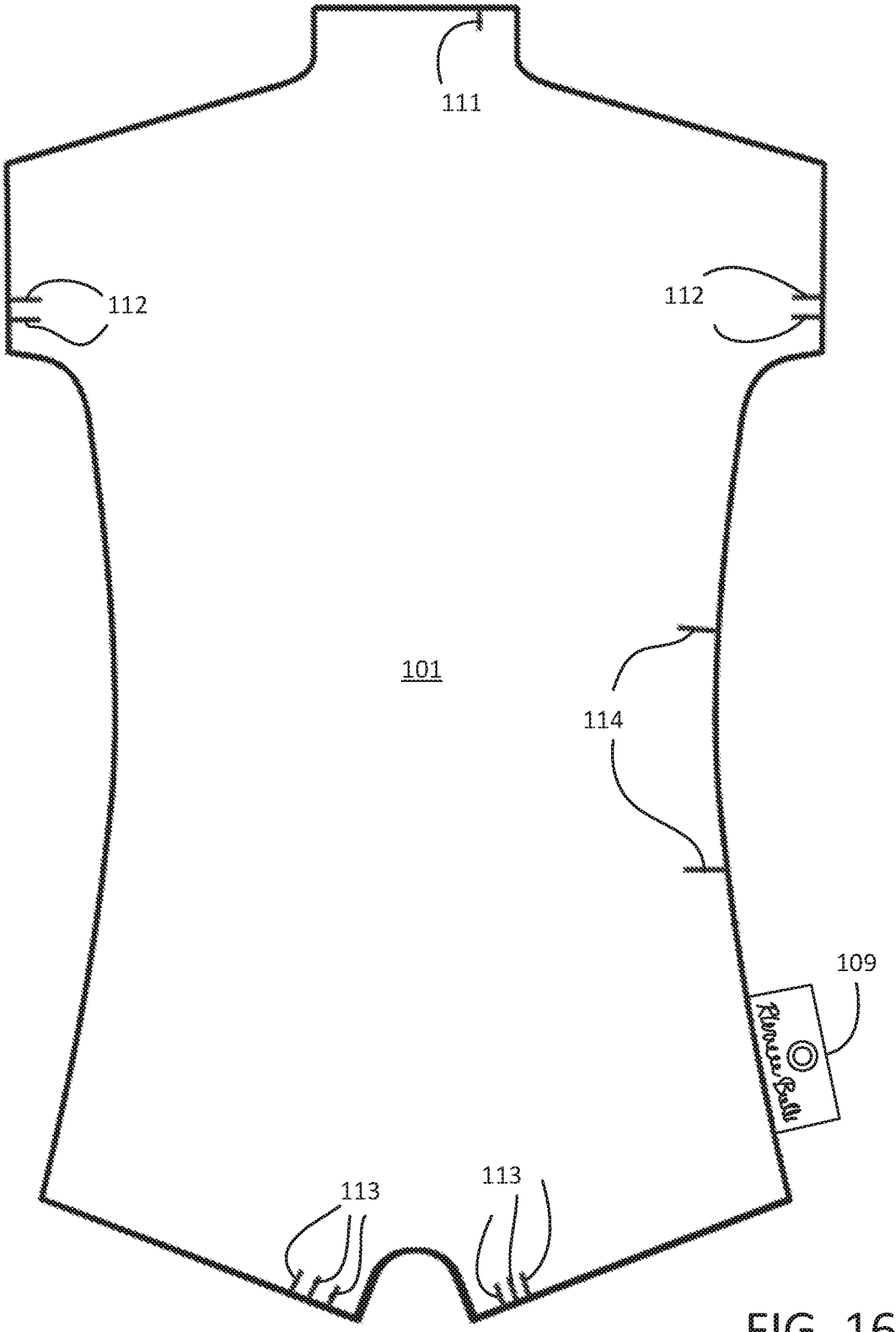
FIG. 16 is a diagram of notch locations in one embodiment of a front or back sheet of the torso-shaped pillow case.

FIG. 16 is a diagram of notch locations in one embodiment of a front or back sheet of the torso-shaped pillow.

A notch 111 is positioned along the edge of the base of the neck. A circular filler pattern 204 (shown in FIG. 16) also has a notch 111 so that it can easily be selected from the various circular filler patterns to be sewn to the base of the neck.

Figure 17:
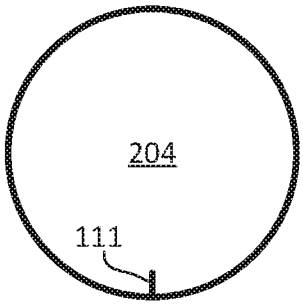
FIG. 17 is a diagram of one embodiment of a circular filler pattern for a neck appendage.

Two notches 112 are positioned along the edge of each of the bases of the arms. A pair of circular filler pattern 202 (such as the one shown in FIG. 17) also has two notches 112 so that they can easily be selected from the various circular filler patterns to be sewn to the base of the arms.

Figure 18:
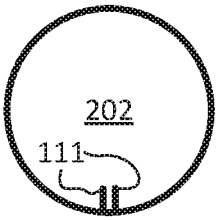
FIG. 18 is a diagram of one embodiment of a circular filler pattern for an arm appendage.

Three notches 113 are positioned along the edge of the base of the legs. A circular filler pattern 203 (such as the one shown in FIG. 18) also has three notches 113 so that they can easily be selected from the various circular filler patterns to be sewn to the base of the legs.

Two notches 114 are spaced apart along one side of the trunk to indicate the alignment for a 10 inch invisible zipper.

A seamstress assembling the torso-shaped pillow case 100 sews the front and back sheets together along the perimeter seams and inserts the invisible zipper between the notches 114. In some embodiments, a brand tag 109 is attached to the perimeter of the torso-shaped pillow case 100.

This seamstress matches the circular filler patterns corresponding to the arms, legs or neck by matching pieces with the same number of notches. Thus, a circular fill pattern that has a single notch will be sewn to the base of the neck. The two circular fill patterns that have a pair of notches will be sewn to the base of the arms. The two circular fill patterns that have three notches will be sewn to the base of the legs.

Figure 19:
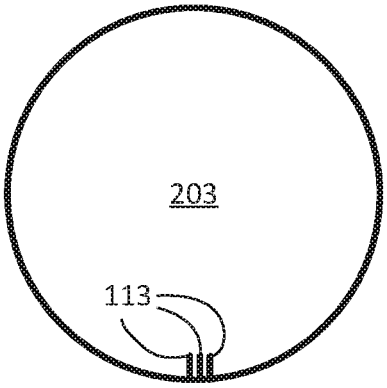
FIG. 19 is a diagram of one embodiment of a circular filler pattern for a leg appendage.
Figure 20:
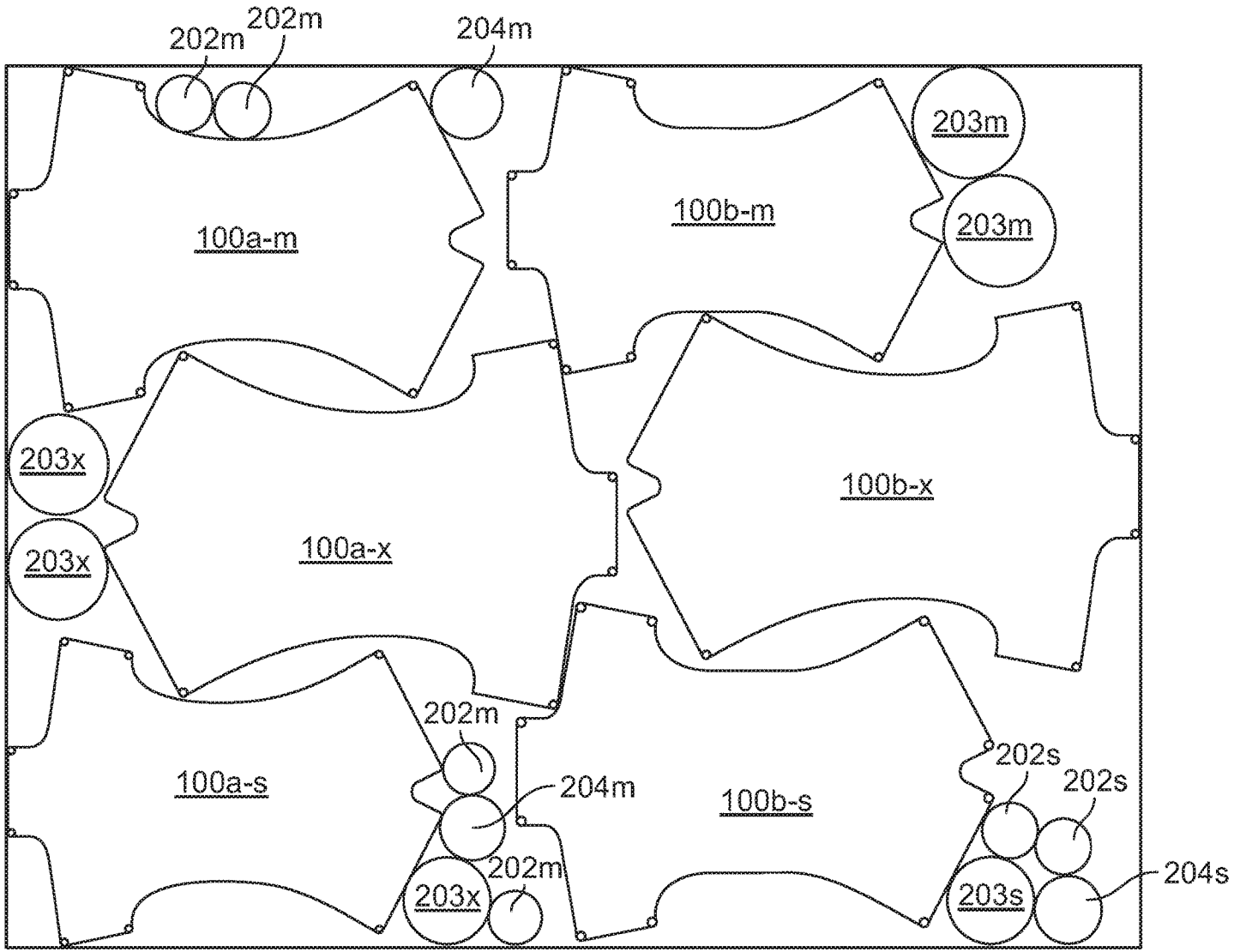
FIG. 20 is a diagram of one embodiment of a production marker for three sizes of the torso-shaped pillow.

FIG. 19 is a diagram of one embodiment of a production marker for three sizes of the torso-shaped pillow. The production marker depicts the optimal layout of the pattern pieces for cutting based on a fabric with a cuttable width of 58 inches.

The production marker for the pattern includes three pairs of torso-shaped cloth sheets—a small front torso-shaped cloth sheet 100*a-s* and a small back torso-shaped cloth sheet 100*b-s*, a medium front torso-shaped cloth sheet 100*a-s* and a medium back torso-shaped cloth sheet 100*b-m*, and a large front torso-shaped cloth sheet 100*a-x* and a large back torso-shaped cloth sheet 100*b-x*.

Each pair of front and back torso-shaped patterns are sewn together at the edges to form a torso-shaped pillow case with circular openings at the ends of the base of the arms, the base of the legs and the base of the neck.

There are circular fill patterns of various sizes on the production marker for the pattern.

The small torso-shaped pillow case 100 uses the circular fill pattern 204*s* for the base of the neck, the pair of circular fill patterns 202*s* for the base of the arms, and the pair of circular fill patterns 203*s* for the base of the legs.

The medium torso-shaped pillow case 100 uses the circular fill pattern 204*m* for the base of the neck, the pair of circular fill patterns 202*m* for the base of the arms, and the pair of circular fill patterns 203*m* for the base of the legs.

The large torso-shaped pillow case 100 uses the circular fill pattern 204*x* for the base of the neck, the pair of circular fill patterns 202*x* for the base of the arms, and the pair of circular fill patterns 203*x* for the base of the legs.

As described herein, the number of notches indicate whether a particular circular fill pattern 202 116 is matched with the opening of the base of the arms, the opening of the base of the legs or the opening of the base of the neck.

Embodiments of the torso-shaped pillow may include longer arm appendages or allow for optional extensions to the arm appendages to accommodate short-sleeve or longer-sleeve garments. For example, the torso-shaped pillow may allow for a cylindrical pillow to be removably attachable to the appendages 102. The cylindrical pillow may extend the arm appendage to accommodate certain clothing, such as short-sleeve, or long-sleeve garments.

Embodiments of the torso-shaped pillow may include longer leg appendages and optional extensions to the appendages for the legs. For example, the torso-shaped pillow may allow for a cylindrical pillow removably attachable to the appendages 103. The cylindrical pillow may extend the leg appendages to accommodate certain clothing, such as garments with short or long leggings.

Embodiments of the extensions for the arms and legs are removably attached to the base of the appendages using Velcro® hook and loop.

Embodiments of the torso-shaped pillow may have the perimeters of the neck, arm and leg openings sewn together without the using any circular filler patterns.

Embodiments of the torso-shaped pillow use snaps, draw strings, buttons, Velcro® hook and loop, or the like to close the opening 107.

The cloth materials for the torso-shaped pillow case may be cotton, linen, polyester, wool, nylon, or rayon, or blends of such materials. In a preferred embodiment, the torso-shaped pillow case is made of a blend of 65 percent polyester and 35 percent cotton. Other materials may be used.

The stuffing material may be, for example, craft stuffing, synthetic foams such as polyester fiber fills, latex, and polystyrene beans, and natural fiber fills such as down, feathers, wool, and cotton.

Embodiments of the torso-shaped pillow are made of an air-tight material with a sealable air valve such that it can be inflated by mouth or by using an air pump. Such air-tight materials may be polyvinyl chloride (PVC), nylon polyester, textile-reinforced urethane plastic, and rubber.

Embodiments of the torso-shaped pillow case includes a zipper opening in the cloth torso-shaped cover to allow for the insertion and removal of a core made of air-tight material having a cavity with a sealable air value so that it can be inflated for use as described herein and deflated for storage and transportation. The core made of air-tight material is shaped to support the torso-shape of the torso-shaped pillow case when inserted into the cloth covering, oriented to align with the corresponding features of the torso-shaped cloth pillow case, and inflated.

The foregoing specification provides a description with reference to specific exemplary embodiments. The specification and drawings are to be regarded in an illustrative sense rather than a restrictive sense. Various modifications may be made thereto without departing from the spirit and scope as set forth in the following claims.

Embodiments of the torso-shaped pillow case includes a rectangular piece of fabric attached at each end to the appendage 104 such that the torso-shaped pillow could be suspended vertically by catching a hook with the space between the secured ends of the rectangular piece of fabric.

What is claimed is:

1. A pillow for altering clothes comprising:

a trunk portion, substantially in the shape of a human trunk;

a first pair of base portions of appendages extending out from the trunk substantially at the position and with the orientation of human arms relative to the human trunk, each substantially in the shape of the base portion of human arms;

a second pair of base portions of appendages extending out from the trunk substantially at the position and with the orientation of human legs relative to the human trunk, each substantially in the shape of the base portion of human legs;

a base portion of an appendage extending out from the trunk, substantially at the position and with the orientation of a neck relative to the human trunk, substantially in the shape of the base portion of a human neck; and a core within the trunk and the base portions of the appendages extending out from the trunk, the core being resilient, wherein the pillow has a closeable opening, the core being removably inserted through the closeable opening.

2. The pillow of claim 1 wherein the resilient core comprises a resilient fill material, the resilient fill material comprising at least one of polyester, polyester pellets, microbeads, beanbag filler, memory foam, cotton, feathers, down, horsehair, shredded rubber, and latex.

3. The pillow of claim 1 wherein the core is inflatable, the inflatable core comprising at least one of polyurethane vinyl chloride (PVC), rubber, textile-reinforced urethane, thermoplastic urethane.

4. The pillow of claim 1 further comprising a pair of removable portions of the appendages each removably coupled to one of the base portions of the arms.

5. The pillow of claim 1 further comprising a pair of removable portions of the appendages each removably coupled to one of the base portions of the legs.

6. A torso-shaped pillow case for a pillow usable to alter clothes wherein the torso-shaped pillow case when substantially filled takes the shape of a portion of a human figure, the portion of the human figure comprising a trunk of the human figure and a plurality of base portions of extremities extending out from the trunk, the plurality of base portions comprising:

a pair of base portions of the arms of the human figure;

a pair of base portions of the legs of the human figure; and a base portion of the neck of the human figure, wherein the torso-shaped cover has a closeable opening, the trunk and plurality of base portions of the extremities extending out from the trunk being fillable through the closeable opening with synthetic fill material or natural fill material.

7. The pillow of claim 6 further comprising a pair of removable portions of the arms each removably coupled to one of the base portions of the arms.

8. A torso-shaped pillow case for a pillow usable to alter clothes wherein the torso-shaped pillow case when substantially filled takes the shape of a portion of a human figure, the portion of the human figure comprising a trunk of the human figure and a plurality of base portions of extremities extending out from the trunk, the plurality of base portions comprising:

a pair of base portions of the arms of the human figure;

a pair of base portions of the legs of the human figure; and a base portion of the neck of the human figure, wherein the torso-shaped cover has a closeable opening, the trunk and plurality of base portions of the extremities extending out from the trunk being fillable through the closeable opening with an inflatable core.

9. The pillow of claim 8 further comprising a pair of removable portions of the arms each removably coupled to one of the base portions of the arms.

* * * * *